US008808021B2

(12) United States Patent
Liu et al.

(10) Patent No.: US 8,808,021 B2
(45) Date of Patent: Aug. 19, 2014

(54) SECURING STRUCTURE HAVING A HOUSING WITH A LATCHING PATCH LATCHING WITH AND PRESSING A SECURING MEMBER

(71) Applicants: Shenzhen Futaihong Precision Industry Co., Ltd., Shenzhen (CN); FIH (Hong Kong) Limited, Kowloon (HK)

(72) Inventors: Zhen-Lin Liu, Shenzhen (CN); Kai Xu, Shenzhen (CN); Wen-Ze Liu, Shenzhen (CN)

(73) Assignees: Shenzhen Futaihong Precision Industry Co., Ltd., Shenzhen (CN); FIH (Hong Kong) Limited, Kowloon (HK)

( * ) Notice: Subject to any disclaimer, the term of this patent is extended or adjusted under 35 U.S.C. 154(b) by 7 days.

(21) Appl. No.: 13/721,623

(22) Filed: Dec. 20, 2012

(65) Prior Publication Data

US 2013/0224981 A1 Aug. 29, 2013

(30) Foreign Application Priority Data

Feb. 23, 2012 (CN) ..... 2012 1 0041904

(51) Int. Cl.
*H01R 13/62* (2006.01)

(52) U.S. Cl.
USPC ..... 439/331

(58) Field of Classification Search
USPC ..... 439/327–331
See application file for complete search history.

(56) References Cited

U.S. PATENT DOCUMENTS

| | | | | |
|---|---|---|---|---|
| 5,600,539 | A * | 2/1997 | Heys et al. | 361/679.32 |
| 6,957,973 | B1 * | 10/2005 | McHugh et al. | 439/331 |
| 7,300,298 | B2 * | 11/2007 | Kameda | 439/326 |
| 7,338,308 | B2 * | 3/2008 | Nakao et al. | 439/331 |
| 8,200,282 | B2 * | 6/2012 | Liang et al. | 455/558 |
| 2004/0137775 | A1 * | 7/2004 | Taguchi | 439/328 |
| 2007/0128913 | A1 * | 6/2007 | Zuo et al. | 439/325 |
| 2013/0115796 | A1 * | 5/2013 | Liu et al. | 439/325 |

* cited by examiner

*Primary Examiner* — Chandrika Prasad
(74) *Attorney, Agent, or Firm* — Novak Druce Connolly Bove + Quigg LLP

(57) ABSTRACT

A securing structure includes a housing, and a securing member. The housing defines a receiving space and includes a base at end of the housing adjacent to the receiving space. The base includes at least one latching patch secured on the base. The securing member includes a latching portion and at least one resisting portion extended from one side of the latching portion. The latching portion detachably engages with the at least one latching patch with an end of the at least one latching patch pressing the resisting portion toward the receiving space.

10 Claims, 3 Drawing Sheets

SECURING STRUCTURE HAVING A HOUSING WITH A LATCHING PATCH LATCHING WITH AND PRESSING A SECURING MEMBER

BACKGROUND

1. Technical Field

The disclosure generally relates to securing structures for flexible printed circuits (FPC), and particularly to a securing structure for a FPC of a portable electronic device.

2. Description of Related Art

Portable electronic devices such as personal computers, mobile phones, and personal digital assistants (PDA) commonly includes electronic members such as cameras and keyboards which are electrically connected to a main board by using a FPC. The FPC includes a connector at end of the FPC. The main board includes a socket. The connector of FPC is electrically connected to the socket to electrically interconnect the FPC and the main board.

However, the connector may be disconnected from the socket when the portable electronic device falls from a high distance or is suddenly impacted.

Therefore, there is room for improvement within the art.

BRIEF DESCRIPTION OF THE DRAWING

Many aspects of the present disclosure can be better understood with reference to the following drawing. The components in the drawing are not necessarily drawn to scale, the emphasis instead being placed upon clearly illustrating the principles of the disclosure.

DETAILED DESCRIPTION

Figure 1:
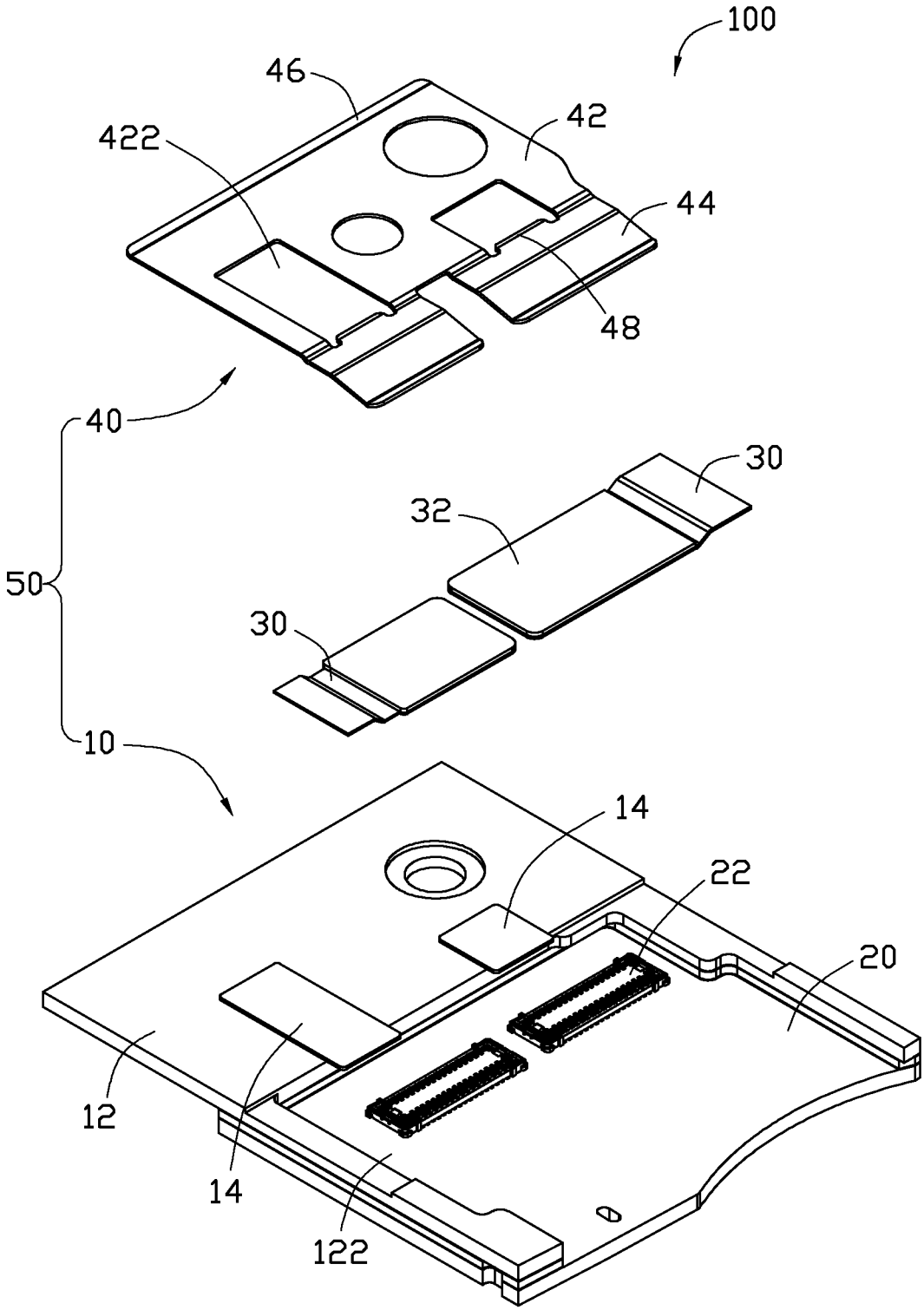
FIG. 1 is a disassembled view of a securing structure for a portable electronic device, according to an exemplary embodiment of the disclosure.

FIG. 1 is a disassembled view of a securing structure 50 for a portable electronic device 100 (partially shown), according to an exemplary embodiment of the disclosure. The portable electronic device 100 can be a mobile phone, a personal digital assistant (PDA) or a personal computer, and the mobile phone is taken here as an example to illustrate the disclosure.

The portable electronic device 100 includes a housing 10, a main board 20 received in the housing 10, and two FPCs (schematically shown) 30 electrically connected to the main board 20, and a securing member 40. The housing 10 and the securing member 40 cooperatively form the securing device 50 configured to secure the FPCs 30 to the main board 20.

The housing 10 is a substantially rectangular board. The housing 10 defines a receiving space 122 and forms a base 12 at an end of the receiving space 122. The receiving space 122 is configured to position the main board 20 and the FPCs 30. Two substantially rectangular latching patches 14 are secured on the base 12 adjacent to the receiving space 122 by soldering. An end of each latching patch 14 protrudes from an edge of the base 12 and is suspended above the receiving space 122.

The main board 20 is positioned in the receiving space 122. Two sockets 22 are positioned on the main board 20 corresponding to the FPCs 30. Each FPC 30 includes a contacting portion 32 facing one of the sockets 22. The contacting portions 32 are correspondingly positioned on the sockets 22 to electrically connect to the main board 20.

The securing member 40 is flexible and includes a latching portion 42 and two resisting portions 44 extended from a first side of the latching portion 42. The latching portion 42 is substantially a flat sheet. Two rectangular through latching holes 422 are defined in the latching section 42 corresponding to the latching patches 14. A length of each latching hole 422 is slightly shorter than that of the corresponding latching patch 14. Each resisting portion 44 is a sheet extended from a side of the latching portion 42 bent toward the receiving space 122 with a step-shaped surface formed between the resisting portion 44 and the latching portion 42.

Figure 2:
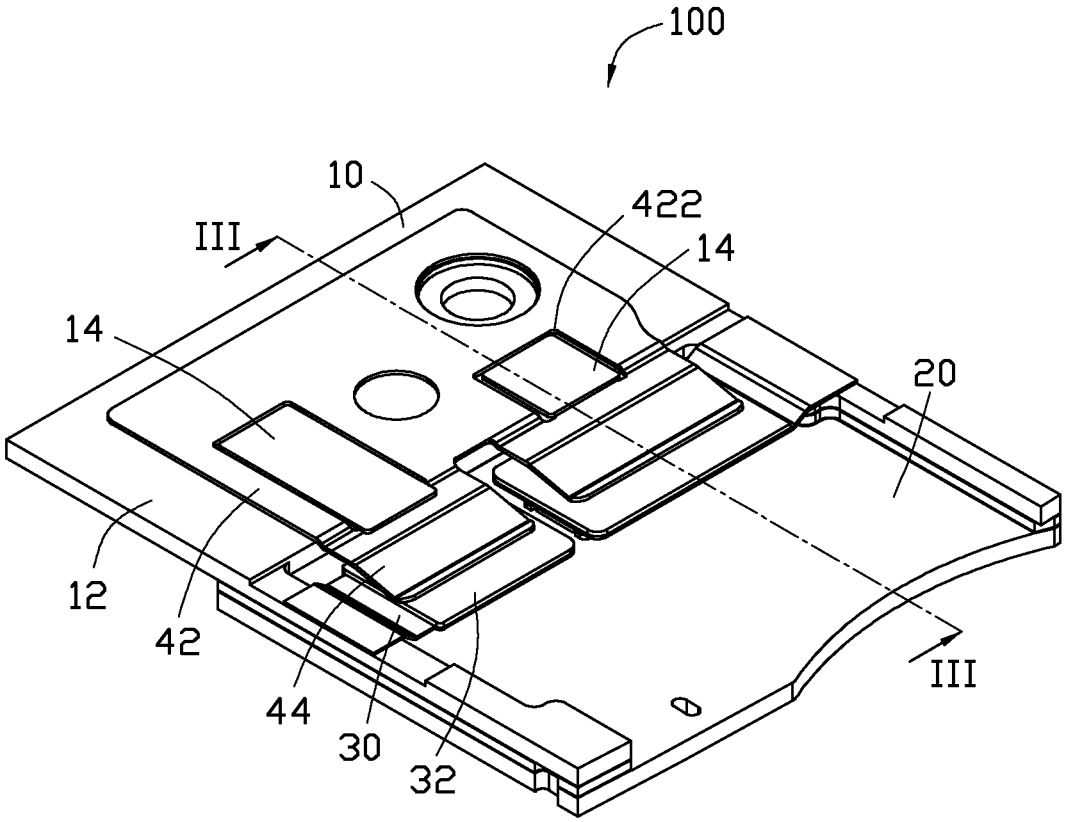
FIG. 2 is an assembled view of the portable electronic device of FIG. 1, according to an exemplary embodiment of the disclosure.
Figure 3:
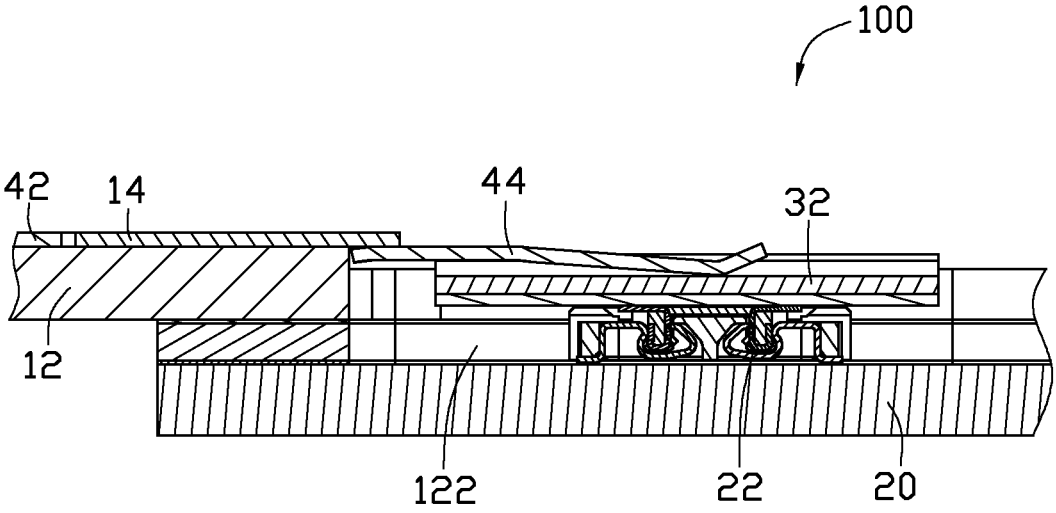
FIG. 3 is a cross-sectional view of the portable electronic device, taken along a line III-III of FIG. 2.

Referring to FIGS. 2 and 3, to assemble the portable electronic device 100, the contacting portions 32 are correspondingly positioned on the sockets 22. The securing member 40 is positioned on the housing 10 with the latching patches 14 are aligned with the latching holes 422. The securing member 40 is slid along a direction from the receiving space 122 toward the base 12 by an external force until the latching patches 14 engage in the latching holes 422 and the ends of the latching patches 14 is exposed from the latching holes 422. The exposed ends of the latching patches 14 press against the resisting portions 44 so that the resisting portions 44 are deformed and resist against the contacting portions 32. The contact portions 32 are pressed toward the sockets 22 and stably contact with the sockets 22. Therefore, the contact portions 32 do not disconnect from the sockets 22 easily even when the portable electronic device 100 is impacted.

In other embodiment, to conveniently remove the securing member 40 from the housing 10, a bent portion 46 (see FIG. 1) may be formed at a second side of the latching portion 44 opposite to the resisting portions 44.

In addition, a guiding portion 48 (see FIG. 1) extends from an inner side of each latching hole 422 adjacent to the resisting portions 44. Each guiding portion 48 guides one of the latching patches 14 to press against the resisting portions 44 while the securing member 40 is slid along the direction from the receiving space 122 toward the base 12.

The numbers of the latching patches 14 and the latching holes 422 can be changed as long as the securing member 40 is secured to the base 12.

It is believed that the exemplary embodiments and their advantages will be understood from the foregoing description, and it will be apparent that various changes may be made thereto without departing from the spirit and scope of the disclosure or sacrificing all of its material advantages, the examples hereinbefore described merely being preferred or exemplary embodiments of the disclosure.

What is claimed is:

1. A securing structure comprising:

a housing defining a receiving space and comprising a base at an end of the housing adjacent to the receiving space; the base comprising at least one latching patch secured on the base; and a securing member comprising a latching portion and at least one resisting portion extended from one side of the latching portion, the latching portion detachably engaging with the at least one latching patch with an end of the at least one latching patch pressing the resisting portion toward the receiving space.

2. The securing structure of claim 1, wherein the latching portion defines at least one latching hole corresponding to the at least one latching patch, the at least one latching patch engages in the at least one latching hole with an end of the at least one latching patch exposed from the at least one latching hole to press the resisting portion.

3. The securing structure of claim 2, wherein the securing member further comprises a guide portion extended from an inner side of each latching hole adjacent to the resisting portions to guide the latching patches press against the resisting portions.

4. The securing structure of claim 1, wherein the securing member further comprises a bent portion formed at a side of the latching portion opposite to the resisting portion opposite to the resisting portion to conveniently remove the securing member from the housing.

5. A portable electronic device, comprising:

a main board comprising a socket;

a FPC comprising a contacting portion, the FPC positioned on the main board with the contacting portion facing the socket;

a securing member comprising:

a housing defining a receiving space, the main board and the FPC received in the receiving space, and the FPC positioned on the main board with the contacting portion facing the socket, the housing comprising a base at end of the housing adjacent to the receiving space; the base comprising at least one latching patch secured on the base; and a securing member comprising a latching portion and at least one resisting portion extended from one side of the latching portion and positioned on the contacting portion, the latching portion detachably engaging with the at least one latching patch with an end of the at least one latching patch pressing the resisting portion toward the receiving space.

6. The portable electronic device of claim 5, wherein the latching portion defines at least one latching hole corresponding to the at least one latching patch, the at least one latching patch engages in the at least one latching hole with an end of the at least one latching patch exposed from the at least one latching hole, the exposed end of the at least one latching patch presses against the at least one latching portion.

7. The portable electronic device of claim 6, wherein the securing member further comprises a guide portion extended from an inner side of each latching hole adjacent to the resisting portions to guide the latching patches press against the resisting portions.

8. The portable electronic device of claim 5, wherein the securing member further comprises a bent portion formed at a side of the latching portion opposite to the resisting portion opposite to the resisting portion to conveniently remove the securing member from the housing.

9. A portable electronic device, comprising:

a housing defining a receiving space and forming a base at an end of the receiving space, the housing comprising at least one latching patch secured on the base with an end of the at least one latching patch protruding from an edge of the base and suspending above the receiving space;

a main board comprising a socket, the main board received in the receiving space;

a FPC comprising a contacting portion, the FPC positioned on the main board with the contacting portion facing the socket;

a securing member secured on the housing, the securing member comprising at least one resisting portion, the protruded end of at least one latching patch pressing the at least one resisting portion resist against the at least one resisting portion.

10. The portable electronic device of claim 9, wherein the securing member further comprises a latching portion, the latching portion defines at least one latching hole corresponding to the at least one latching patch, the at least one latching patch engages in the at least one latching hole.

* * * * *